United States Patent [19]

Grilliot et al.

[11] Patent Number: 4,941,213

[45] **Date of Patent: * Jul. 17, 1990**

[54] FIREFIGHTER'S BOOT AND TROUSER ATTACHMENT

[76] Inventors: William L. Grilliot; Mary I. Grilliot, both of 1986 Home Ave., Dayton, Ohio 45417

[ * ] Notice: The portion of the term of this patent subsequent to Nov. 14, 2006 has been disclaimed.

[21] Appl. No.: 410,729

[22] Filed: Sep. 21, 1989

Related U.S. Application Data

[63] Continuation of Ser. No. 215,300, Jul. 15, 1988, Pat. No. 4,879,769.

[51] Int. Cl.[5] ..... A41F 17/04

[52] U.S. Cl. ..... 2/312; 2/313; 2/232; 36/1.5

[58] Field of Search ..... 2/22, 23, 231, 232, 2/233, 242, 300, 304, 308, 309, 311, 312, 313, 314, 315, 316, 317, 318, 320, 321, 322, 323, 326, 330, 332, 333, 336, 337, 338; 36/1.5, 2 R

[56] References Cited

U.S. PATENT DOCUMENTS

| | | | |
|---|---|---|---|
| 1,361,565 | 12/1920 | Christy | 2/313 |
| 2,525,756 | 10/1950 | Aines | 2/232 |
| 2,596,112 | 5/1952 | Aines | 2/232 |
| 4,498,201 | 2/1985 | Carter | 2/312 |

FOREIGN PATENT DOCUMENTS

| | | | |
|---|---|---|---|
| 40627 | 12/1907 | Switzerland | 36/1.5 |
| 148733 | 8/1931 | Switzerland | 36/1.5 |

*Primary Examiner*—Werner H. Schroeder
*Assistant Examiner*—Diana L. Biefeld
*Attorney, Agent, or Firm*—Jacox & Meckstroth

[57] ABSTRACT

An attachment device for attaching a firefighter's trousers to the firefighter's boots, in which the trousers cover a portion of the firefighter's boots. The attachment device maintains the firefighter's trousers in covering relationship to the boots, and portions of the trousers cannot become lodged on the upper edge of the boots as the firefighter bends and crawls and the like. Each attachment device has a band which encompasses one of the firefighter's boots. A strap extends from the band and has fastener elements which attach to portions of the firefighter's trousers which encompass the boot. Thus, the trousers are attached to the boot.

11 Claims, 1 Drawing Sheet

FIREFIGHTER'S BOOT AND TROUSER ATTACHMENT

This application is a continuation of application Ser. No. 215,300, filed July 5, 1988, now U.S. Pat. No. 4,879,769.

BACKGROUND OF THE INVENTION

A firefighter normally wears boots. A firefighter also normally wears trousers which cover a portion of the boots. The trousers conventionally have a plurality of protective layers.

During firefighting activities a firefighter frequently finds it necessary to bend over, to crawl, and to assume various strenuous body positions. When these movements and positions occur, a portion of the trousers or one of the layers of the trousers may be drawn upwardly with respect to the boots and caught at the upper edge of one or both of the boots. When this occurs, the protection provided to the lower portion of the firefighter's leg is reduced. After the firefighter assumes an upright position, it is necessary for the firefighter to dislodge the portion of the trousers which has become lodged on the upper edge of the boot. Such dislodging requires additional time and energy of a firefighter who is busily engaged in fighting a fire.

It is therefore an object of this invention to provide attachment means by which a firefighter's boots and trousers are attached together in a manner to prevent any portion of the trousers from becoming lodged at the upper edge of the firefighter's boots.

It is another object of this invention to provide such attachment means which can be easily and readily attached to the firefighter's boots and trousers.

It is another object of this invention to provide such attachment means which, if desired, can be permanently secured to a firefighter's boots or trousers.

It is another object of this invention to provide such attachment means which includes adjustment means to accommodate boots and trousers which have various dimensions.

Other objects and advantages of this invention reside in the construction of parts, the combination thereof, the method of production and the mode of use, as will become more apparent from the following description.

SUMMARY OF THE INVENTION

An attachment device of this invention comprises a band which encompasses a portion of a firefighter's boot. One or more straps are attached to the band and extend from the band. The straps and the trousers are provided with fastener means for fastening the strap to the trousers. Thus, the trousers are secured to the boot, and the lower portions of the trousers are maintained adjacent the lower part of the boot, and no portion of the trousers can become lodged at the upper edge of the boot.

DETAILED DESCRIPTION OF THE INVENTION

Figure 1:
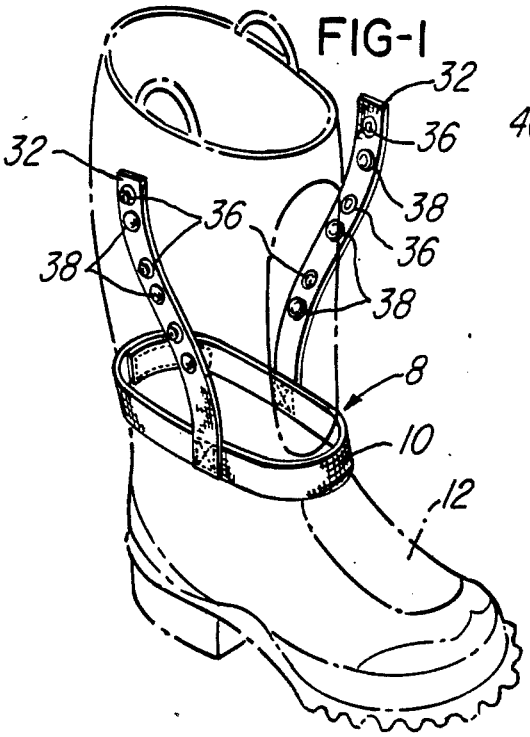
FIG. 1 is a front perspective view, illustrating the attachment device of this invention attached to a firefighter's boot.

An attachment device 8 of this invention comprises an elongate band 10, which is adapted to wrap around a firefighter's boot 12 as best illustrated in FIG. 1. The elongate band 10 is provided with means at each end thereof for attaching the two ends together for attaching the band 10 to the boot 12. Herein the band 10 is shown as having hook and pile elements at the ends thereof for attachment of the ends together. Herein a hook or pile element 18 is secured to one end of the band 10, and a hook or pile element 20 is secured to the other end of the band 10.

Extending at an angle from the band 10 is a plurality of strips or straps 32. The strips or straps 32 are attached to the band 10 by any suitable means, such as by stitching, or by any other attachment method. The straps 32 are adapted to be positioned on opposite sides of the firefighter's boot. Each of the straps 32 carries a plurality of fastener elements 36 and a plurality of fastener elements 38. Each of the fastener elements 36 has a protuberance, and each of the fastener elements 38 has a complementary recess which is adapted to resiliently receive a protuberance of a fastener element 36. The fastener elements 36 and 38 are alternately arranged along the length of the straps 32.

Figure 2:
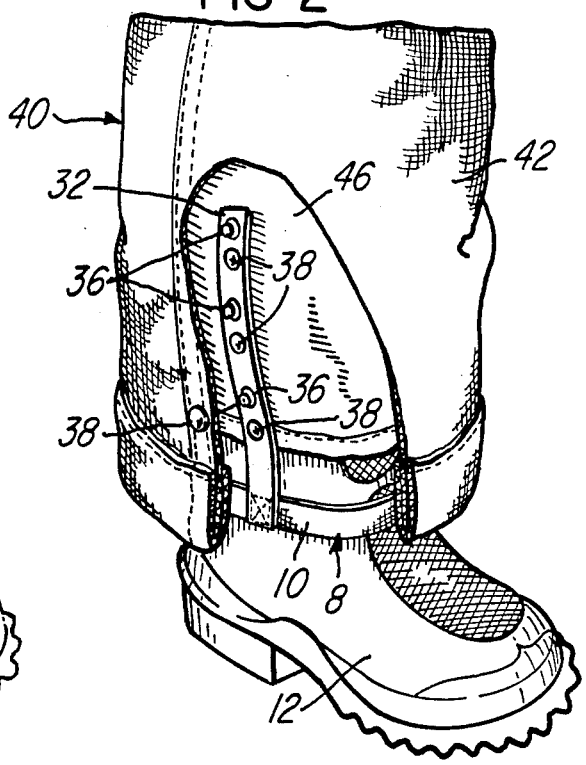
FIG. 2 is a front perspective view, drawn on substantially the same scale as FIG. 1, with parts broken away and shown in section, and showing the attachment device of this invention attached to a firefighter's boot, and illustrating the manner in which the attachment device is attached to trousers of a firefighter.

The band 10 of the attachment device 8 is placed around a lower portion of the boot 12 and the hook and pile elements 18 and 20 are attached together so that the band 10 fits tightly around the boot 12, as shown in FIGS. 1 and 2.

Figure 3:
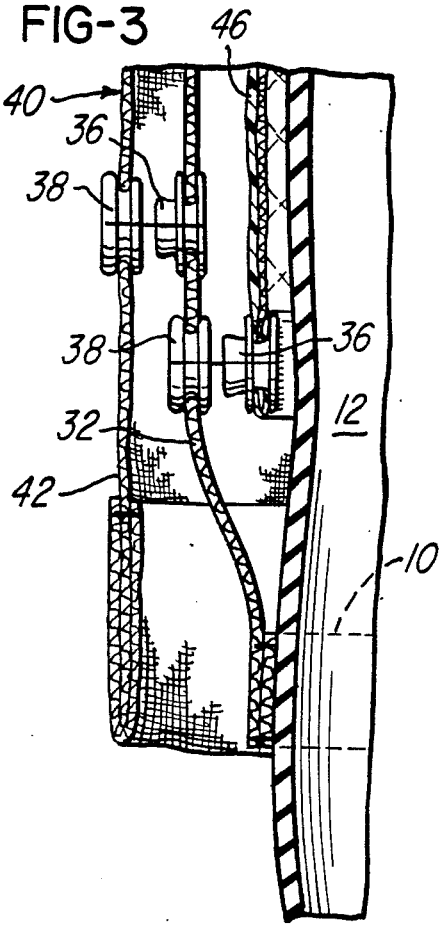
FIG. 3 is a greatly enlarged sectional view, showing an attachment device of this invention attached to a firefighter's boot and showing fastener elements attached to layers of the trousers of a firefighter, and illustrating attachment of the attachment device to the firefighter's trousers.
Figure 4:
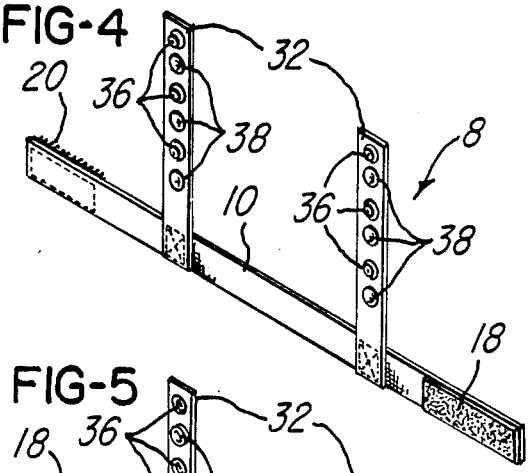
FIG. 4 is a perspective view, drawn on a slightly larger scale than FIGS. 1 and 2, and showing an attachment device of this invention in a "laid-out" condition, and showing one surface of the attachment device of this invention.
Figure 5:
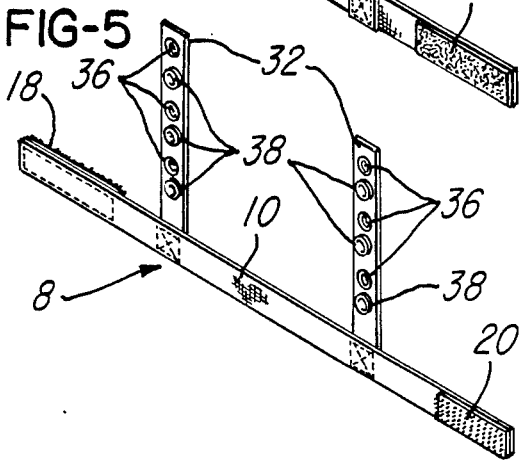
FIG. 5 is a perspective view, similar to FIG. 4, and drawn on substantially the same scale as FIG. 4, and showing the reverse surface of the attachment device of FIG. 4.

Trousers 40 encompass a major portion of the boot 12. The trousers 40 have an outer layer 42 and an inner layer 46. A fastener element 38 is shown attached to the outer layer 42 of the trousers 40, as illustrated in FIG. 3. A fastener element 36 is shown attached to the inner layer 46 of the trousers 40. A fastener element 36 which is carried by the strap 32 is attached to the fastener element 38 which is carried by the outer layer 42 of the trousers 40. A fastener element 38 which is carried by the strap 32 is attached to a fastener element 36 which is carried by the inner layer 46, as illustrated in FIG. 3.

Thus, the inner layer 46 and the outer layer 42 are secured to the boot 12 by means of the band 10 and by means of the straps 32 and the fastener elements 36 and 38. Thus, the portions of the trousers 40 to which the fastener elements 36 and 38 are secured are maintained adjacent the boot 12. Therefore, a portion of the trousers 40 cannot become lodged at the upper edge of the boot 12.

The fastener elements 36 and 38 are readily secured to the outer layer 42 and the inner layer 46 of the trousers 40. An attachment device 8 of this invention is easily attached to a boot 12, as the band 10 is placed in encompassing relationship to the boot 12 and the hook and pile elements 18 and 20 are attached together. Due to the fact that the band 10 is adjustable in circumference, the attachment device 8 is adapted to be attached to a boot 12 of any size and dimension. The fastener elements 36 and 38 which are carried by the straps 32 are readily attached to the fastener elements 36 and 38 which are carried by the inner layer 46 and the outer layer 42.

Due to the fact that the straps 32 have a series of fastener elements 36 and 38 carried thereby, the fastener elements 36 and 38 which are carried by the straps 32 can be attached to an adjacent fastener element 36 or 38 which is carried by the inner layer 46 and the outer layer 42.

The attachment device 8 of this invention is constructed of flame resistant and moisture resistant material. If desired, the attachment device 8 or portions thereof may be constructed of elastic type material.

Although the preferred embodiment of the firefighter's boot and trouser attachment of this invention has been described, it will be understood that within the purview of this invention various changes may be made in the form, details, proportion and arrangement of parts, the combination thereof, the method of construction and the method of use, which generally stated consist in an attachment device and method within the scope of the appended claims.

The invention having thus been described, the following is claimed.

1. Attachment structure for use by a firefighter who wears a pair of firefighter's boots and a pair of firefighter's trousers comprising first connection means, the first connection means being secured to the firefighter's trousers and carried thereby, second connection means, the second connection means being releasably attached to the first connection means, third connection means, the third connection means being in supporting relationship to the second connection means, the third connection means extending from the trousers to the boots and encompassing a portion of the firefighter's boots and attached thereto, whereby the firefighter's trousers are attached to the firefighter's boots.

2. The attachment structure of claim 1 in which the firefighter's trousers have a leg portion, and in which the first connection means comprises a first fastener element, the first fastener element being attached to the leg portion of the trousers, and in which the third connection means comprises an elongate member, the second connection means comprising a second fastener element, the second fastener element being secured to the elongate member, the second fastener element being releasably attached to the first fastener element, and means attaching portions of the elongate member together as the elongate member encompasses a portion of the firefighter's boot.

3. Attachment structure for use by a firefighter who wears a pair of firefighter's boots and a pair of firefighter's trousers comprising first connection means, the first connection means being secured to the firefighter's trousers and carried thereby, second connection means, the second connection means being releasably attached to the first connection means, third connection means, the third connection means being in supporting relationship to the second connection means, the third connection means extending from the firefighter's trousers to the firefighter's boots, means attaching the third connection means to the firefighter's boots, whereby the firefighter's trousers are attached to the firefighter's boots.

4. The attachment structure of claim 3 in which the firefighter's trousers have leg portions, and in which the first connection means comprises a plurality of first fastener elements, at least one of the first fastener elements being secured to each of the leg portions of the firefighter's trousers, and in which the third connection means comprises a plurality of straps, the second connection means comprising a plurality of second fastener elements, at least one of the second fastener elements being secured to each of the straps, each of the second fastener elements being releasably attached to one of the first fastener elements, and means attaching each of the straps to one of the firefighter's boots.

5. The attachment structure of claim 3 in which firefighter's trousers have an outer layer and an inner layer and in which the first connection means includes means attached to the outer layer and to the inner layer of the firefighter's trousers.

6. Attachment structure for use by a firefighter who wears a pair of firefighter's trousers and a pair of firefighter's boots, the firefighter's trousers having a leg portion, the leg portion including a plurality of layers of protective material, comprising connection means, means attaching the connection means to at least one of the layers of the leg portion of the firefighter's trousers, the connection means extending from the leg portion of the firefighter's trousers, the connection means including means in engagement with one of the firefighter's boots and encompassing the firefighter's boot and attached thereto, whereby the firefighter's trousers are attached to the firefighter's boots.

7. Attachment structure for use by a firefighter who wears a pair of firefighter's trousers and a pair of firefighter's boots, the firefighter's trousers having a leg portion, comprising connection means, means attaching the connection means to the leg portion of the firefighter's trousers, the connection means extending from the leg portion of the firefighter's trousers, the connection means including means in engagement with one of the firefighter's boots and encompassing the firefighter's boot and attached thereto, whereby the firefighter's trousers are attached to the firefighter's boots, the leg portion of the firefighter's trousers including an outer layer and an inner layer, and the connection means including means attached to the outer layer and to the inner layer of the leg portion of the firefighter's trousers.

8. Attachment structure for use by a firefighter who wears a pair of firefighter's trousers and a pair of firefighter's boots, the firefighter's trousers having a leg portion, the leg portion including a plurality of layers of protective material, comprising connection means, means attaching the connection means to at least one of the layers of the leg portion of the firefighter's trousers, the connection means extending from the leg portion of the firefighter's trousers, the connection means including means for attachment of the connection means to one of the firefighter's boots, whereby the leg portion of the firefighter's trousers is attached to the firefighter's boot.

9. Attachment structure for use by a firefighter who wears a pair of firefighter's trousers and a pair of firefighter's boots, the firefighter's trousers having a leg portion, comprising connection means, means attaching the connection means to the leg portion of the firefighter's trousers, the connection means extending from the leg portion of the firefighter's trousers, the connection means including means for attachment of the connection means to the firefighter's boots, whereby the leg portion of the firefighter's trousers is attached to the firefighter's boot, the leg portion of the firefighter's trousers including an outer layer and an inner layer, and the connection means including means attaching the connection means to the outer layer and to the inner layer of the leg portion of the firefighter's trousers.

10. For use with a firefighter's boots and firefighter's trousers, as the firefighter's trousers have a leg portion which is normally in juxtaposition with a boot of the firefighter, the leg portion having a plurality of layers of protective material, attachment structure comprising an elongate flexible member, means attaching the elongate flexible member to at least one of the layers of the leg portion of the firefighter's trousers, and means attaching the elongate flexible member to the boot of the firefighter, whereby the leg portion of the firefighter's trousers is attached to the firefighter's boot.

11. For use with a firefighter's boots and firefighter's trousers, as the firefighter's trousers have a leg portion which is normally in juxtaposition with a boot of the firefighter, attachment structure comprising an elongate flexible member, means attaching the elongate flexible member to the leg portion of the firefighter's trousers, and means attaching the elongate flexible member to the boot of the firefighter, whereby the leg portion of the firefighter's trousers is attached to the firefighter's boot, the leg portion of the firefighter's trousers having an outer layer and an inner layer, and the attachment structure including snap means attached to the outer layer and to the inner layer of the leg portion of the firefighter's trousers, and the attachment structure including complementary snap means attached to the elongate flexible member whereby the elongate flexible member is attached to the inner layer and to the outer layer of the leg portion of the firefighter's trousers.

* * * * *